United States Patent [19]

Archer

[11] 4,074,731

[45] Feb. 21, 1978

[54] COMPLIANT MESH STRUCTURE AND METHOD OF MAKING SAME

[75] Inventor: John S. Archer, Palos Vardes Peninsula, Calif.

[73] Assignee: TRW Inc., Redondo Beach, Calif.

[21] Appl. No.: 644,985

[22] Filed: Dec. 29, 1975

Related U.S. Application Data

[62] Division of Ser. No. 484,635, July 1, 1974, Pat. No. 3,982,248.

[51] Int. Cl.[2] ..... B21F 27/10

[52] U.S. Cl. ..... 140/112; 29/452; 219/58; 140/3 R

[58] Field of Search ..... 140/3 R, 112, 71 R, 140/107, 108, 109; 165/81; 343/897; 29/452; 219/56, 58

[56] References Cited

U.S. PATENT DOCUMENTS

| | | | |
|---|---|---|---|
| 2,161,019 | 6/1939 | Coy | 165/81 |
| 3,234,556 | 2/1966 | Tanner | 343/897 |

*Primary Examiner*—Lowell A. Larson

*Attorney, Agent, or Firm*—Donald R. Nyhagen; John J. Connors; Benjamin DeWitt

[57] ABSTRACT

A wire mesh structure, primarily for space applications, characterized by its lightweight, its compact stowage and deployment capability, and its ability to maintain its shape under widely varying thermal conditions. The structure has a frame supporting a wire mesh including wires which are terminally secured to the frame and constitute the primary structural elements of the mesh. These structural wires are preformed to a spring-like configuration which renders the wires resiliently compliant with a low spring rate in the endwise direction and are stretched to produce a predetermined tension preload in the wires when the mesh is installed on the supporting frame. This preload retains the mesh in a taut condition under widely varying thermal conditions and thereby prevents the formation of slack in the mesh which would allow out-of-plane displacement of the mesh. The invention also encompasses a method of fabricating the mesh and the mesh structure and is described in relation to a wire mesh parabolic dish antenna.

2 Claims, 4 Drawing Figures

COMPLIANT MESH STRUCTURE AND METHOD OF MAKING SAME

The invention herein described was made in the course of or under a contract or subcontract thereunder, (or grant), with the Department of the Air Force.

This is a division, of application Ser. No. 484,635, filed July 1, 1974 now U.S. Pat. No. 3,982,248

RELATED APPLICATIONS

The present U.S. Patent application is related to copending applications of Elmer Smith and Samuel Weinstein entitled "Welding Method and Machine for Fabricating a Wire", filed May 24, 1974, Ser. No. 473,109, now U.S. Pat. No. 3,961,153 and David W. Moore entitled "Variable Property Wire Mesh Structure", filed Aug. 5, 1974, Ser. No. 494,691, now U.S. Pat. No. 3,987,457.

BACKGROUND OF THE INVENTION

1. Field of the Invention

This invention relates generally to lightweight stowable and deployable structures for spacecraft and other applications and more particularly to a novel wire mesh structure of this kind and to its method of fabrication.

2. Prior Art

As will appear from the later description, the wire mesh structure of the invention may assume a variety of forms depending upon its intended use. The particular structure described is an antenna reflector, specifically a parabolic dish reflector, for a spacecraft.

A high premium is placed on the weight of spacecraft components, such as antennas, which must be traded off against all aspects of the total system performance to obtain an optimum design. This is particularly true in systems requiring parabolic surfaces as antenna reflectors. The technical requirements of minimum distortions for high performance, a need for stowage during the boost phase, combined with exposure to the extremes of the orbital environment after deployment, place severe constraints on the design.

A variety of spacecraft antennas have been devised in an attempt to satisfy the above and other design constraints. These existing antennas, however, fail to fully satisfy all the constraints. For example, antennas having rigid reflector surfaces, such as utilized in the sunflower concept, have the disadvantage of relatively high weight ratios and stowage space difficulty; coated fabric surfaces have the disadvantage of poor electrical characteristics and deterioration in the space radiation environment; and metallic fabric surfaces, in general, have the disadvantage of extreme sensitivity to dimensional tolerances, and are subject to large temperature excursions which cause large thermal distortions and thus result in significant areas of slack mesh between supports.

SUMMARY OF THE INVENTION

According to one of its more limited aspects, this invention provides a novel wire mesh antenna reflector and its method of fabrication which avoid the above noted and other disadvantages of the existing reflectors and satisfy the stated spacecraft antenna design constraints. Simply stated, the antenna reflector is characterized by a wire mesh reflecting surface having wires which constitute primary structural elements of the mesh and are attached at their ends to the reflector frame. These structural elements or wires are preformed to a low rate spring-like configuration which renders the wires resiliently compliant in the endwise direction and are stretched to produce a predetermined preload in the wires when the mesh is installed in the frame. The preload retains the mesh in a taut condition under widely varying thermal conditions, such as those encountered by an orbiting earth satellite, thus preventing the creation of slack in the mesh which would permit out-of-plane displacement of the mesh.

The particular antenna reflector described is a parabolic dish reflector having a supporting frame with a central hub and ribs extending radially from the hub. These ribs and the front face of the hub are curved or contoured to conform to a parabolic surface curvature. The spaces between adjacent ribs are spanned by wire mesh gores according to the invention having wires, referred to herein as hoop wires, extending generally circumferentially or hoopwise of the dish and other wires, referred to as radial wires, extending generally radially of the dish. The hoop wires are the preformed primary structural wires and are terminally secured to the ribs. The radial wires stabilize the mesh and cooperate with the hoop wires to provide the required electrical characteristics of the reflector. The resilient compliancy and preload of the hoop wires accomodates thermal distortions of the ribs which result in variation of the rib spacing without the creation of slack in the gores which would allow out-of-plane displacement of the gores. The reflector ribs may comprise strain energy deformable elements which may be folded or otherwise deformed, along with the mesh, for compact stowage of the reflector and extended by stored elastic strain energy in the ribs for deployment of the reflector to its parabolic dish configuration.

As noted earlier, while the invention is described in connection with an antenna reflector, the wire mesh structure of the invention may be designed for other uses. Some of these other uses, for example, are antenna feed structures, electrical ground planes, and supporting structures for thin film solar arrays. Moreover, while the described antenna reflector has preformed resiliently compliant structural wires extending in only one direction of the mesh, some mesh structures may utilize such compliant wires in both orthogonal directions of the mesh.

The invention is also concerned with a method of fabricating the wire mesh and mesh structure of the invention. According to this aspect of the invention, the crossing wires of the mesh are welded or otherwise joined to one another while the preformed compliant structural wires are stretched under a load equal to the desired preload in the latter wires in the finished structure. When this load is removed after the welding operation is completed, the compliant wires contract to their normal unstressed length. However, when the mesh is installed on its supporting frame, the wires are again stretched to produce the predetermined preload in the wires.

DESCRIPTION OF THE PREFERRED EMBODIMENTS

Figure 1:
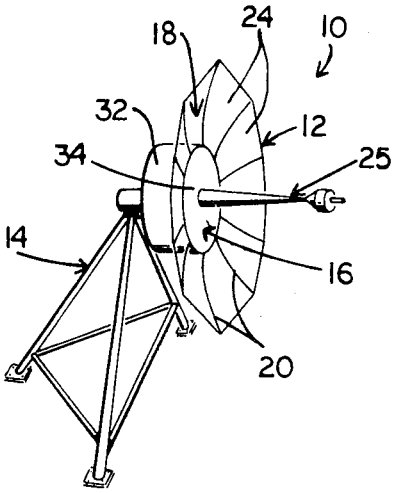
FIG. 1 is a perspective view of a parabolic dish antenna embodying a wire mesh structure, i.e., an antenna reflector dish, according to the invention.

FIG. 1 illustrates an antenna 10 embodying an antenna reflector 12 according to the invention and a reflector support or mount 14. Reflector 12 has a supporting structure or frame 16 and a wire mesh reflecting surface 18 secured to the frame. The frame 16 includes spaced supporting members 20 and the reflecting surface 18 comprises a number of wire mesh panels 24 positioned between and attached to the frame members. The antenna feed is shown at 25.

Figure 2:
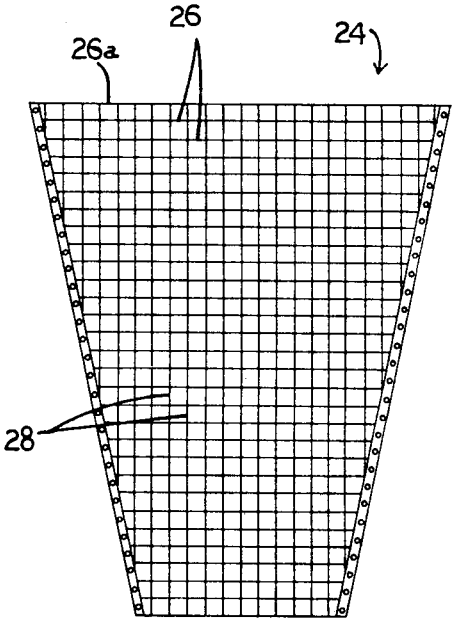
FIG. 2 is an enlarged fragmentary view of the reflector dish.
Figure 3:
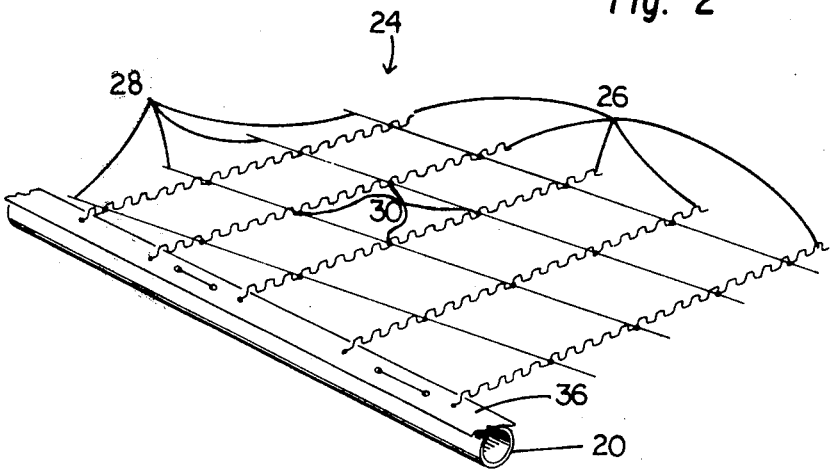
FIG. 3 is a further enlarged fragmentary perspective view of the wire mesh.
Figure 4:
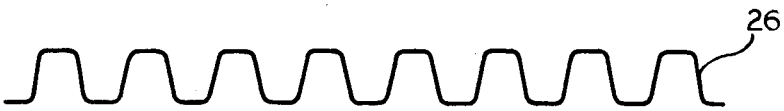
FIG. 4 is a further enlarged view of one wire of the mesh.

Referring to FIGS. 2 through 4, each wire mesh reflector panel 24 has parallel wires 26 crossing other parallel wires 28, in this instance in orthogonal relation, and means physically and electrically joining the crossing wires at their crossing points 30. As explained below, the wires may be spot welded to one another at their crossing points.

Mesh wires 26 constitute the primary structural elements or wires of the mesh panels 24 and are secured at their ends to the adjacent frame members 20. The remaining wires 28 serve to stabilize the mesh and cooperate with the wires 26 to provide the reflector with the required electrical characteristics.

A primary feature of novelty of the invention resides in the fact that the structural wires 26 of each mesh panel 24 are preformed to a low rate spring-like configuration to render these wires resiliently compliant in their endwise direction. As will be explained later, the preformed wires 26 are stretched during installation of the mesh panels on the frame 16 to produce a predetermined tension preload in the wires. This preload maintains the mesh of the panels taut over a wide range of thermal conditions, such as those encountered by an orbiting earth satellite, thereby preventing the creation of slack in the mesh which would permit out-of-plane displacement of the mesh. Such displacement, of course, would degrade the antenna performance.

FIG. 4 illustrates the preferred preformed spring configuration of the wires 26. Other configurations could be utilized, of course. The illustrated configuration is a generally serpentine configuration which may be produced in the manner explained later. Suffice it to say here that the preformed configuration of FIG. 4 obviously renders the wires 26 resiliently compliant in their endwise direction.

The particular antenna reflector shown is a parabolic reflector dish. The reflector frame 16 has a central cylindrical hub-like housing 32 with a front face 34. The mesh supporting members 20 of the frame are slender ribs which are secured to the housing 32, generally flush with its face 34, and extending radially from the housing. The housing face and the ribs are parabolically contoured and curved to conform to a common parabolic surface curvature. The wire mesh panels 24 are mesh gores positioned between and secured to the ribs 20.

The mesh wires 26 and 28 of each gore 24 extend generally hoopwise, that is circumferentially, and generally radially of the reflector dish and, for this reason, are referred to herein as hoop and radial wires, respectively. The hoop wires 26 are the primary structural wires which are terminally secured to the ribs 20 and preformed and preloaded as explained earlier to maintain the mesh panels in a taut condition during thermal deformation of the ribs. The radial wires 28 stabilize the mesh panels and coact with the hoop wires 26 to provide the desired electrical characteristics of the reflector. According to the preferred practice of the invention, the hoop wires 26 are not directly attached to the reflector frame ribs 20 but rather are spot welded or otherwise joined to metallic edge strips 36 which extend along the radial edges of the gores 24 and, in turn, are secured to the ribs. The radially outermost hoop wires **26*a*** of the gores may be heavier wires or cables which extend between the outer tips of the ribs to stabilize the ribs circumferentially. If desired, additional rib stabilizing hoop cables may be placed at other radial positions along the gores. These cables may be fabricated of a material which has optimum thermal characteristics and may be readily temperature controlled with thermal coatings.

As noted earlier, the hoop wires 26 are preformed to their illustrated spring-like configuration and preloaded to maintain the wire mesh gores 24 taut over a wide range of thermal conditions, such as those encountered by an orbiting earth satellite. Thus, in such an environment, the ribs 20 of the reflector frame 16 are subjected to widely varying thermal conditions, i.e., sun in front, sun behind, sun at various angles relative to the bore sight, and no sun, eclipse conditions. These varying conditions result in exposure of the reflector to a temperature range on the order of $+300°$ F to $-300°$ F and produce thermal deformations of the ribs which cause relative movement of adjacent ribs and thereby changes in the rib spacing. If the hoop wires 26 of the wire mesh gores 24 were simple straight wires, relative movement of adjacent ribs toward one another as a consequence of thermal deformation of either or both ribs would produce slack in the hoop wires 26 of the intervening gore and thereby slack in the gore itself. This slack would allow out-of-plane displacement of the mesh with resultant degradation of the antenna performance.

The use of hoop wires 26 which are preformed to a low rate spring configuration and preloaded as described, prevents such slack from developing and maintains the gores 24 in a taut condition and thereby optimum antenna performance over the entire temperature range and under all the varying thermal conditions of the space environment. Thus, as described below, the hoop wires 26 of each gore 24 are stressed in tension and thereby stretched or elongated from their normal unstressed length during assembly of the gore on the reflector frame 16, thereby producing a preload tension in the wires. This preload, i.e., preload tension is made such that the tension fluctuations which occur in the hoop wires during operation of the antenna in the space environment never result in the development of slack in the wires. As a consequence, the hoop wires remain under tension and the antenna mesh remains taut over the entire range of thermal conditions of the space environment.

It is significant to recall here that in the illustrated antenna reflector, only the hoop wires 26 serve as primary structural or load bearing elements. The radial wires 28 serve merely to stabilize the wire mesh and coact with the hoop wires to provide the required electrical characteristics of the reflector. These radial wires are not loaded, which assures that Poisson ratio coupling does not occur between the hoop and radial wires. This, in turn, prevents reflector surface distortions of an antielastic nature which would pull the hoop wires out-of-plane between the ribs 20.

Accordingly, in the illustrated antenna reflector, only the hoop wires 26 need be preformed to a spring configuration. As noted earlier, however, a wire mesh of the invention may be used in structures other than antenna reflectors. In some of these other structures, both wires of the mesh, that is both sets of orthogonal wires, may serve as structural elements which are secured to the mesh supporting frame. In these applications, the wires of both sets may be preformed.

As noted earlier, another aspect of the invention is concerned with a method of fabricating the wire mesh and wire mesh structure of the invention. According to this method, the wires of the mesh are welded or otherwise joined to one another while the compliant structural wires, i.e., the hoop wires 26 of the illustrated reflector, are under a tension load equal to the desired preload in the wires of the finished mesh structure. This load thus produces in the wires the same stretch or elongation which exists in the wires of the finished structure. When the load is removed, of course, following joining of the wires to form a mesh, the compliant structural wires contract to their normal unstressed condition or length. However, when the mesh is then installed on the mesh supporting frame, the structural wires are re-stretched to produce the preload in these wires.

Consider, for example, the above fabrication method as applied to the production of a reflector gore 24. In this case, the gore radial wires 28 and edge strips 36 are first supported in a manner which provides the same wire and edge strip spacing as exists in the finished gore when the latter is installed on the reflector frame 16. The preformed hoop wires 26 are then joined to the radial wires and edge strips while the hoop wires are under a load equal to the preload in these wires in the finished reflector. When the load is removed from the hoop wires following this operation, the hoop wires contract, resulting in relative movement of the radial wires and edge strips toward one another to reduce the wire and edge strip spacing. When installing the gore on the frame, the edge strips are pulled away from one another and secured to a pair of adjacent frame ribs 20, thereby restretching the hoop wires to produce the preload in these wires.

It is apparent that the compliant structural wires of a mesh according to the invention may be preformed to their spring shape in various ways and that the orthogonal mesh wires may be joined in various ways. The earlier mentioned copending applications describe a device for preforming the wires and a welding machine for joining the mesh wires. After preforming the structural wires to their spring shape and prior to joining of the mesh wires to produce the finished mesh, the preformed wires are conditioned by temporarily subjecting them to a tension load greater than the maximum tension load they will be subjected to during use of the finished mesh. This prestressing operation assures that the wires will not be subjected to excessive deformation in use, which would change the wire spring rate or stiffness. The actual spring rate or stiffness of the reflector gores 24 may thus be accurately predetermined and maintained over the full operating lifetime of the reflector.

A wire mesh antenna reflector dish according to the invention has been constructed using stainless steel wire of about 0.002 inches in diameter. This wire was woven into bundles of seven (7) wires each, joined by silver solder and seven (7) of these bundles were woven into a strand which was utilized as the hoop and radial wires.

I claim:

1. The method of fabricating a wire mesh of the character described comprising the steps of:

selecting first wires which are preformed to a spring-like configuration which renders the wires resiliently compliant in their endwise directions and second wires;

placing said second wires in spaced side-by-side relation; and joining said first wires to said second wires to form a mesh wherein said first wires are disposed in crossing relation to and spaced along said first wires by placing each first wire in crossing relation to said second wires, exerting a tension load on the first wire to stretch the latter wire, and joining the latter wire to the second wires at the wire crossing points while the first wire is under said tension load.

2. The method of fabricating a wire mesh structure of the character described comprising the steps of:

selecting first wires which are preformed to a spring-like configuration which renders the wires resiliently compliant in their endwise directions and second wires;

placing said second wires in spaced side-by-side relation;

joining said first wires to said second wires to form a mesh wherein said first wires are disposed in crossing relation to and spaced along said first wires by placing each first wire in crossing relation to said second wires, exerting a tension load on the first wire to stretch the latter wire, and joining the latter wire to the second wires at the wire crossing points while the first wire is under said tension load;

selecting a mesh supporting frame; and securing said mesh to said frame by stretching said mesh in the endwise direction of said first wires to produce in said first wires a tension preload equal to said first mentioned tension load and securing the ends of said first wires to said frame wires to said frame while said first wires are under said preload.

* * * * *